US006196568B1

(12) United States Patent
Stevens

(10) Patent No.: US 6,196,568 B1
(45) Date of Patent: Mar. 6, 2001

(54) ROBUST ADJUSTABLE ROTARY POSITIONING MECHANISM

(75) Inventor: Rex W. Stevens, Erie, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 09/267,455

(22) Filed: Mar. 12, 1999

(51) Int. Cl.[7] ..... G05G 5/06

(52) U.S. Cl. ..... 280/304.1; 74/527; 403/83; 403/95; 403/107

(58) Field of Search ..... 280/250.1, 304.1; 74/527; 403/83, 84, 92, 95, 93, 104, 106, 107

(56) References Cited

U.S. PATENT DOCUMENTS 4,407,045 * 10/1983 Boothe ..... 16/327
5,056,805 * 10/1991 Wang ..... 280/47.36
5,347,883 * 9/1994 Thony ..... 74/551.3
5,689,999 11/1997 Wiley et al. .

* cited by examiner

*Primary Examiner*—Kevin Hurley
(74) *Attorney, Agent, or Firm*—MacMillan, Sobanski & Todd, LLC

(57) ABSTRACT

An adjustable rotary positioning mechanism comprising a clevis having a central axis, a first arm, a second arm, and a plurality of bores arcuately spaced around the central axis through the first arm of the clevis. A rod end having a central axis and a plurality of sockets is rotatably connected to the clevis through the central axis. The plurality of sockets are arcuately spaced around the central axis and positioned colinearly with the plurality of bores. A plurality of locking pins are carried in the sockets and configured to project into the plurality of bores to lock the clevis and the rod end together and to retract from the plurality of bores to permit relative movement of the clevis and the rod end. Another embodiment of the invention is a wheelchair comprising a frame, drive wheels and steerable wheels supporting the frame, and paired foot supports each adjustably connected to the frame using the adjustable rotary positioning mechanism described above.

26 Claims, 8 Drawing Sheets

ROBUST ADJUSTABLE ROTARY POSITIONING MECHANISM

BACKGROUND OF THE INVENTION

This invention relates in general to wheelchairs and to a rotary adjustment mechanism for wheelchair components. More particularly, the invention relates to a mechanism for releasably locking two relatively rotatable members for adjusting the positioning of a wheelchair footrest or other components.

Wheelchairs generally include a frame that supports a pair of drive wheels and a pair of front casters. The drive wheels make contact with the ground and are driven to propel the wheelchair. The drive wheels may be driven manually or powered by an electrical motor. The wheelchair frame also supports a seat assembly comprising a seat and a backrest. The seat assembly is oriented above and between the drive wheels and the front casters to provide stability. Generally, a pair of rigid frame extensions extend off the frame relatively forward from the front casters. Paired foot supports, is consisting of a foot support arm and a foot support plate, are connected to the rigid frame extensions.

Typically, each foot support is joined to its corresponding frame extension using an adjustable mechanism to permit the angle of each foot support to be easily adjusted to meet the specific needs of the user. For example, if the wheelchair user has a leg or foot fracture or other injury in one leg, the foot support can be adjusted to position the affected limb parallel to the ground.

An adjustable locking mechanism is described in U.S. Pat. No. 5,689,999, titled *Adjustable Rotary Locking and Unlocking Apparatus.* This locking mechanism consists of two members rotatably connected by a bolt through a central bore. A first member has a plurality of arcuately spaced locking pins that are movable between a projected and a retracted position. A second member has a plurality of arcuately spaced sockets configured so that each socket can accommodate any of the locking pins. To reposition the foot support, the user pushes an actuator to retract all the locking pins into the second member thereby permitting the first member and the second member to rotate freely relative to each other.

Any mechanism for adjusting the angle of the foot support must be solidly constructed because the foot support arm acts as a lever arm to concentrate pressure placed on the foot support plate. In the rotary locking apparatus described in the '999 patent, pressure on the footplate is focused on the bolt. The '999 patent describes careful fabrication to provide a snug fit between the locking pins and the sockets and the supporting bolt and the central bore. Unfortunately, this increases cost without a proportional increase in the overall strength of the mechanism.

Thus, it would be desirable to have an improved adjustable rotary positioning mechanism of increased strength that can be inexpensively fabricated.

SUMMARY OF THE INVENTION

The present invention provides an improved adjustable rotary positioning mechanism that is more robust and less expensive to manufacture than previous -designs. This adjustable rotary mechanism consists of a rotatable rod end in combination with a clevis, where relative rotation between the clevis and the rod end is prevented by spring loaded locking pins, at least one of which engages a series of uniformly distributed bores in one arm of the clevis. More particularly, the mechanism comprises a clevis having a central axis, a first arm, a second arm, and a plurality of bores arcuately spaced around the central axis through the first arm of the clevis. A rod end having a central axis and a plurality of sockets is rotatably connected to the clevis through the central axis. The plurality of sockets are arcuately spaced around the central axis and positioned colinearly with the plurality of bores. A plurality of locking pins are carried in the sockets and configured to project into the plurality of bores to lock the clevis and the rod end together and to retract from the plurality of bores to permit relative movement of the clevis and the rod end.

Another embodiment of the invention is a wheelchair comprising: a frame, drive wheels and steerable wheels supporting the frame, and paired foot supports each of which is adjustably connected to the frame using an adjustable rotary positioning mechanism as described above.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

The present invention relates to an improved adjustable rotary positioning mechanism that is particularly useful for adjustably connecting components to wheelchairs.

Figure 1:
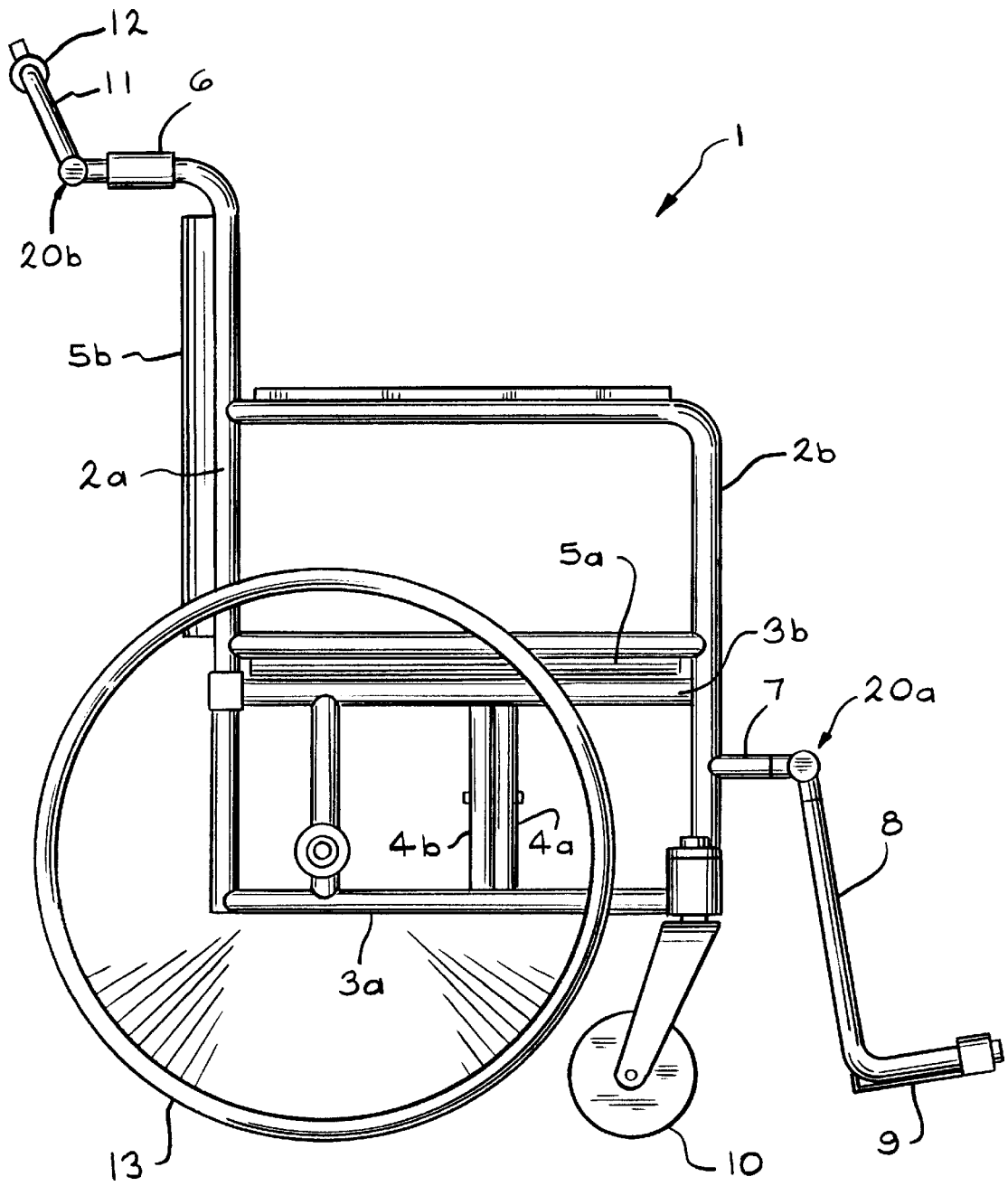
FIG. 1 is an elevational view of a wheelchair including adjustable rotary positioning mechanisms of the present invention adjustably connecting the foot supports and a stroller handle to the wheelchair frame.

Referring now to the drawings, there is illustrated in FIG. 1, a wheelchair indicated generally at 1, with embodiments of adjustable rotary positioning mechanisms of the present invention incorporated into the handle and footrests of a wheelchair 1. The wheelchair frame is constructed with spaced apart, vertical frame members 2*a* and 2*b*, joined together by horizontal cross members 3*a* and 3*b*, and cross bars 4*a* and 4*b*. A seat 5*a* and a backrest 5*b* are supported in the frame. Handle extensions 6 extend from the rear vertical frame members 2*b*. Projecting forward from the horizontal cross members 3*a* rigid frame extensions 7. The rigid frame extensions 7 are coupled to footrest supports 8, that are in turn connected to foot support pads 9. The frame is supported on steerable front wheels 10, and rear drive wheels 13.

Adjustable rotary positioning mechanisms 20*a* and 20*b* (referred to generically as 20) according to the present invention are shown as providing a means of adjustably coupling the handle extensions 6 to a stroller handle 11 and the rigid frame extensions 7 to the foot rest supports 8.

The adjustable rotary positioning mechanisms 20*b* coupling the handle extensions 6 and the stroller handle 11 are optionally configured with a remote actuator 12 that permits the simultaneous adjustment of the rotary positioning mechanisms 20*b*. This permits the stroller handle 11 to be easily moved up and down to adjust to a height desired by the individual pushing the wheelchair 1. The adjustable rotary positioning mechanisms 20*a* are individually actuated to permit independent adjustment of the angle of the footrest supports 8 and the attached foot support pads 9.

Figure 2:
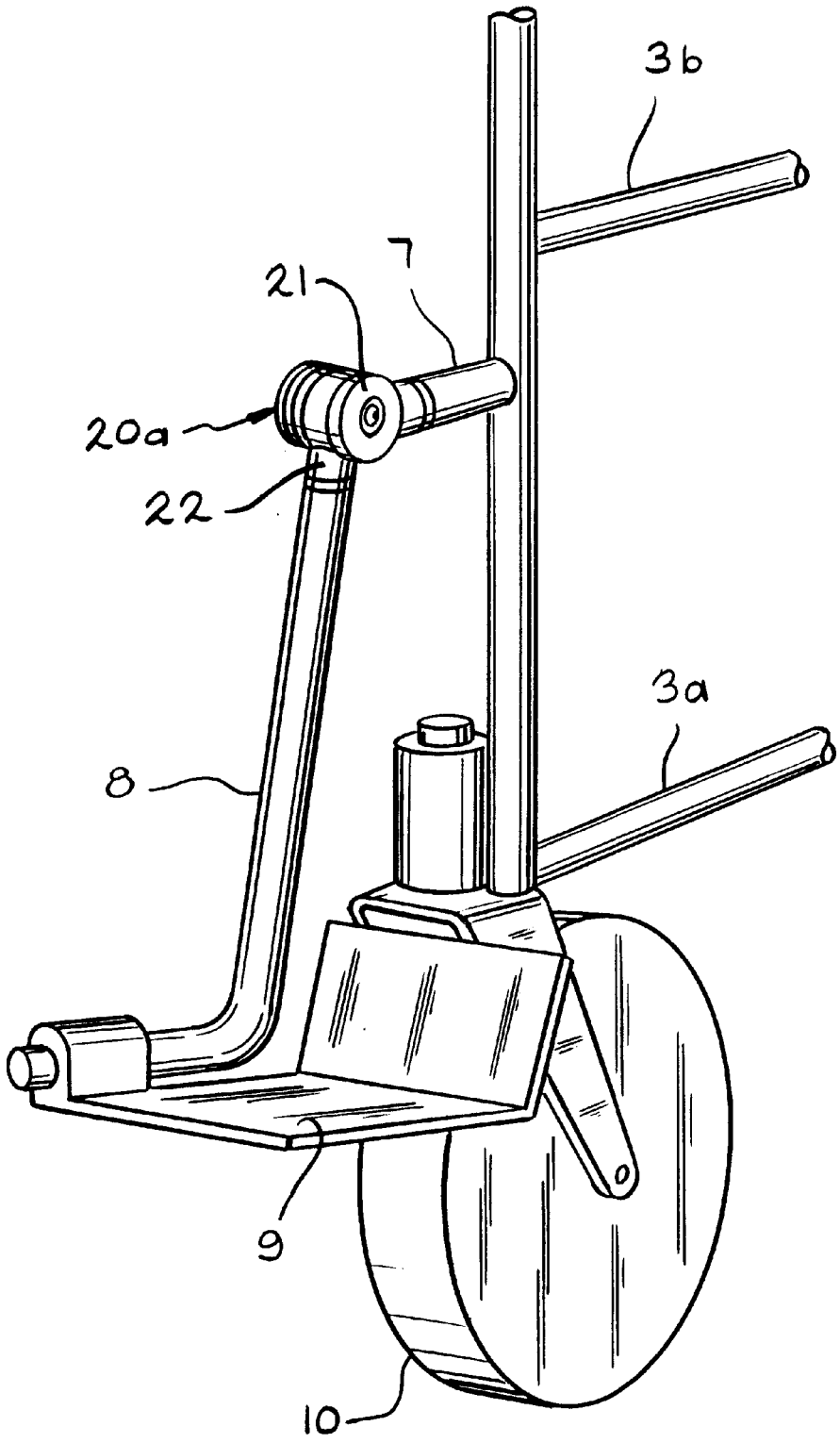
FIG. 2 is an enlarged fragmentary perspective view of a portion of FIG. 1 illustrating the adjustable rotary positioning mechanism of the invention joining one of the foot supports to the wheelchair frame.
Figure 3:
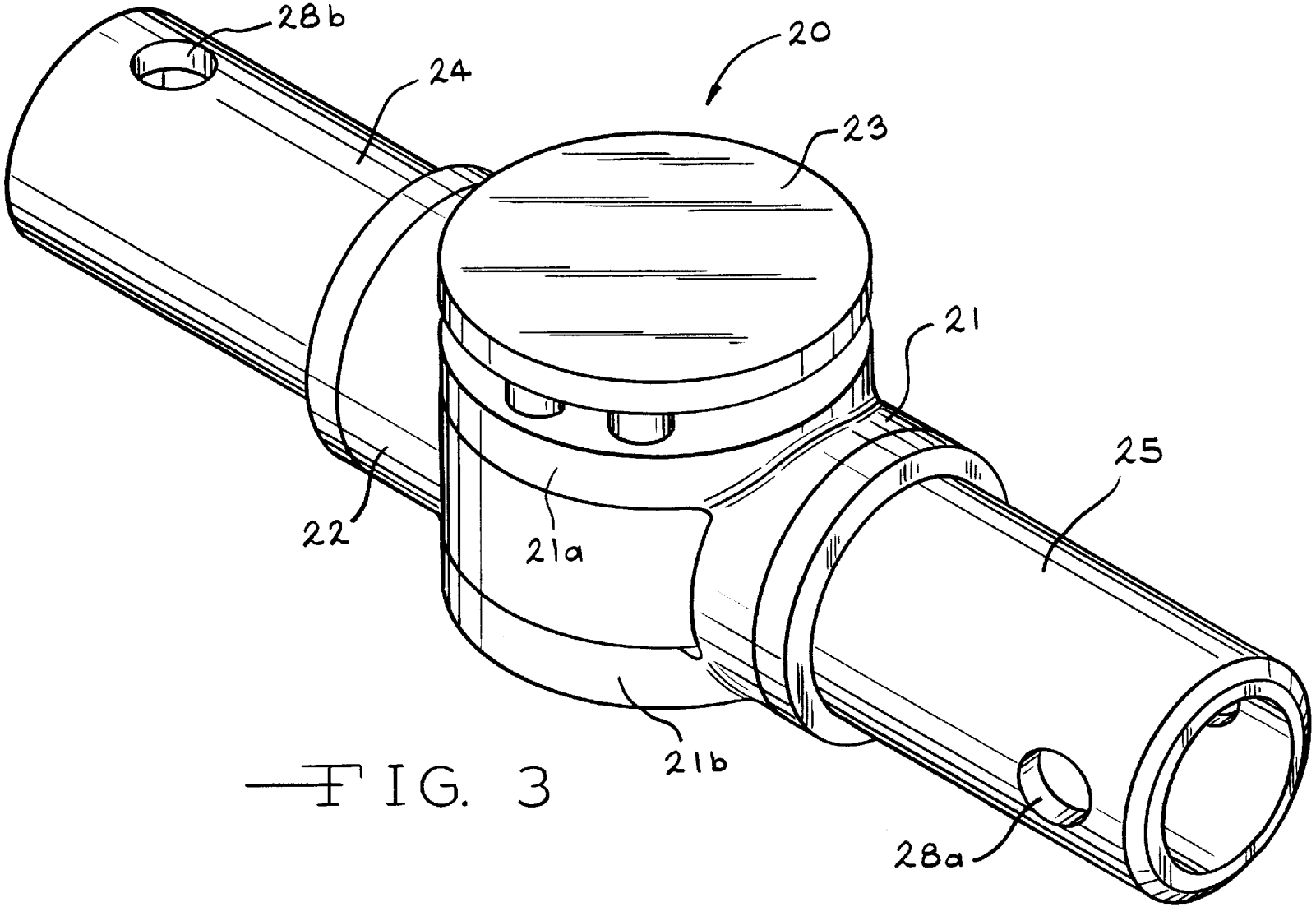
FIG. 3 is a perspective view of the actuator side of the adjustable rotary position mechanisms shown in FIGS. 1 and 2.
Figure 4:
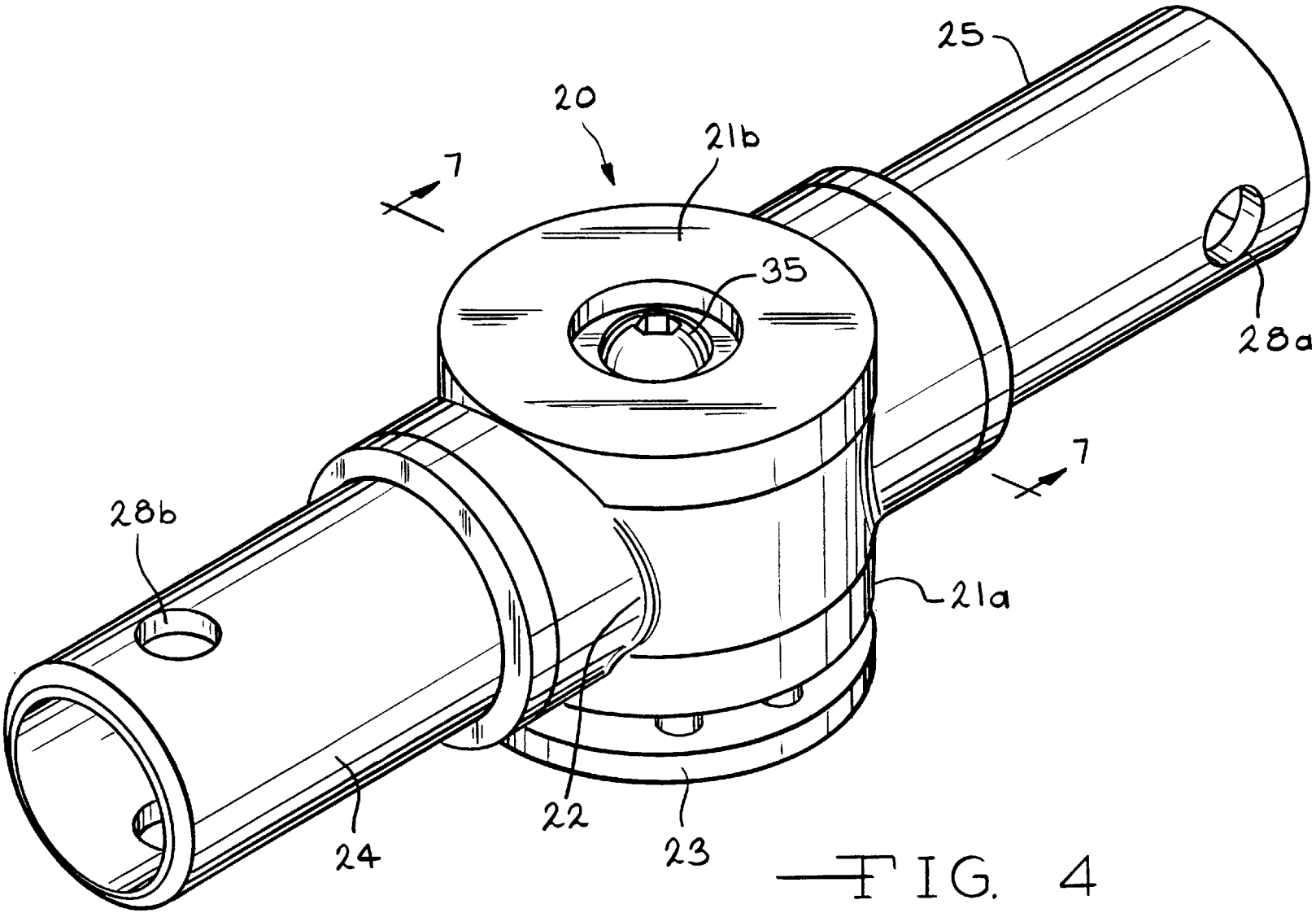
FIG. 4 is a perspective view of the bore side of the adjustable rotary position mechanisms shown in FIGS. 1 and 2.
Figure 5:
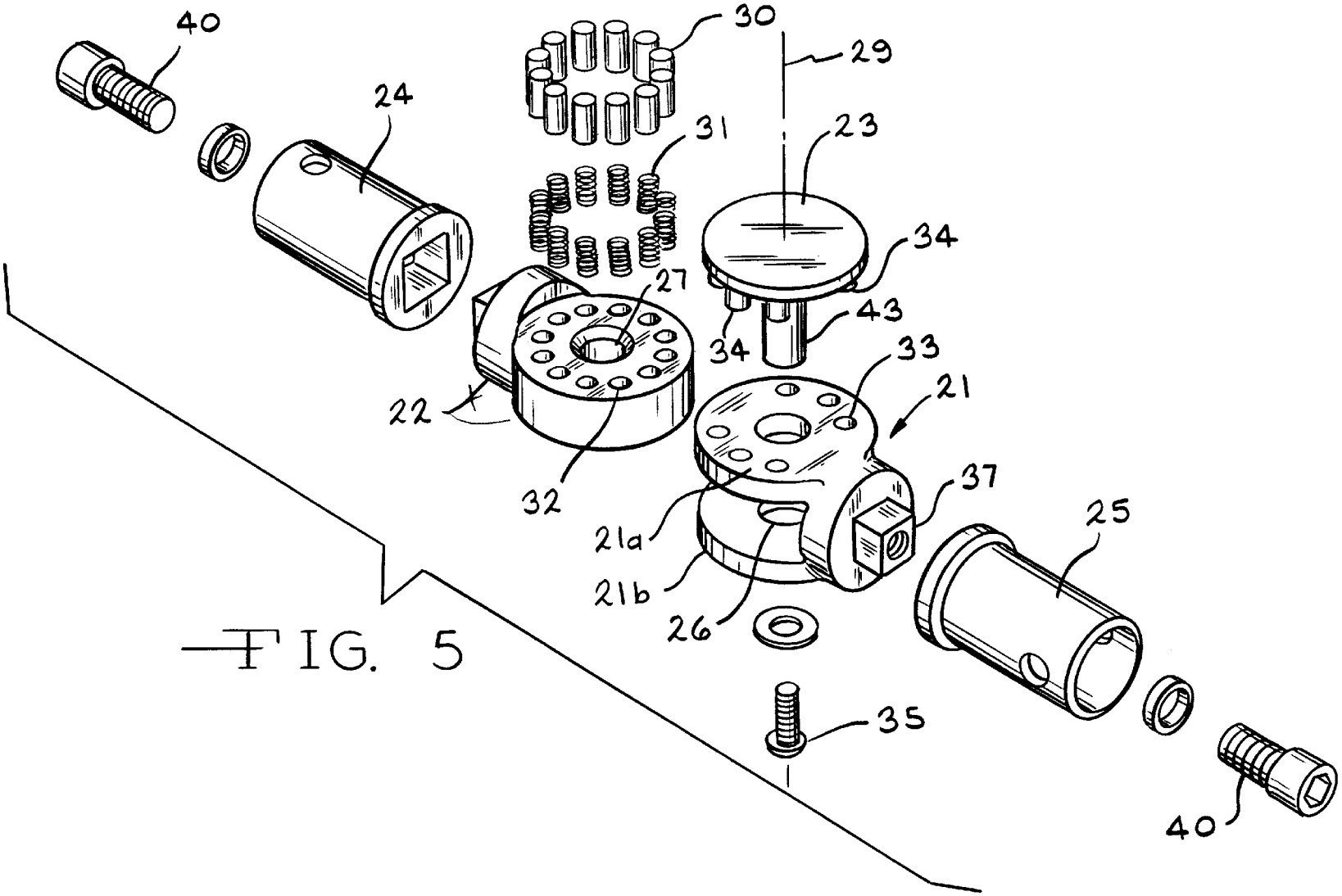
FIG. 5 is an exploded view of the actuator side of the invention as shown in FIG. 3.
Figure 6:
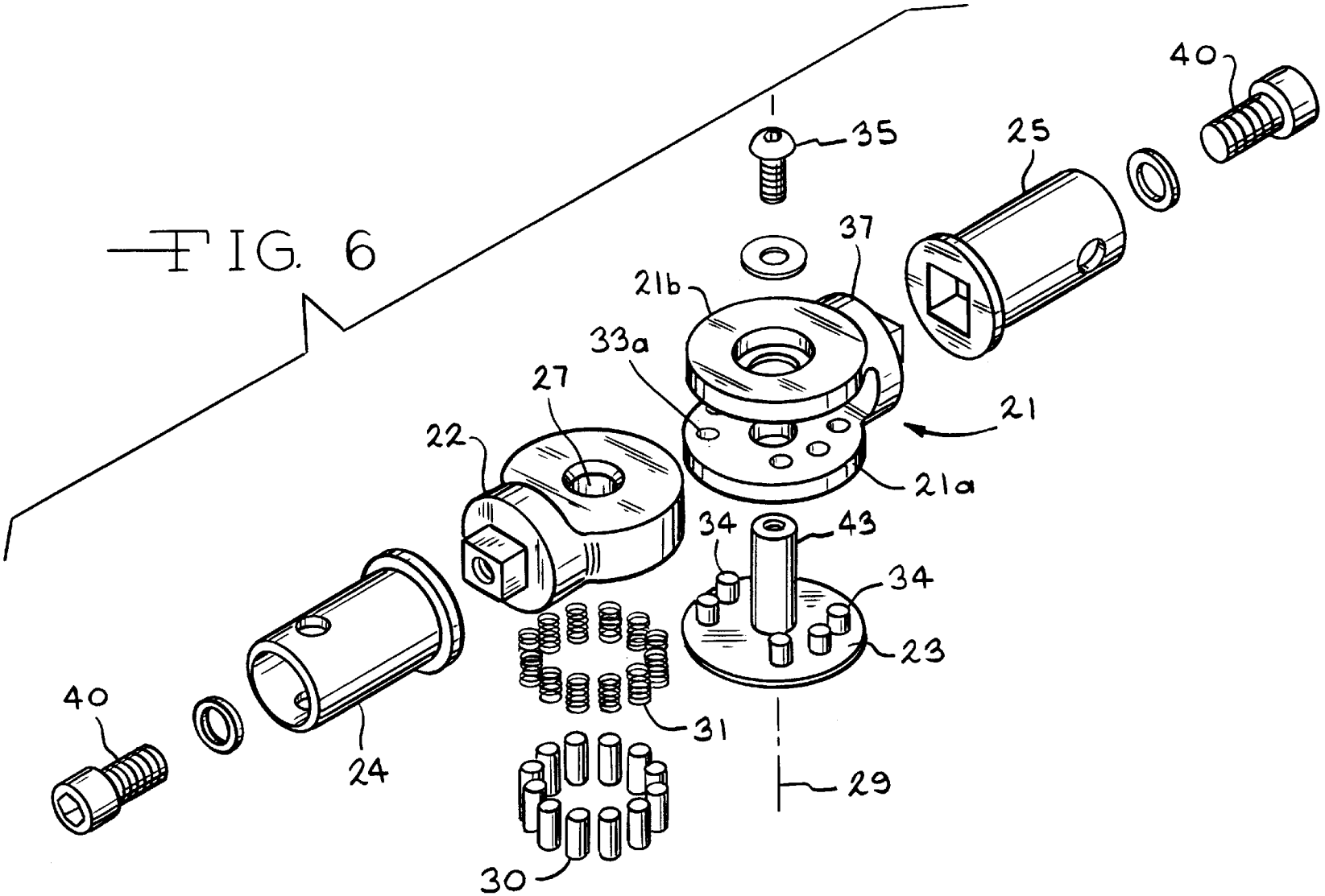
FIG. 6 is an exploded view of the bore side of the invention as shown in FIG. 4.

As visible in FIG. 2 and FIGS. 3 and 4, an adjustable rotary positioning mechanism 20 according to the present invention comprises a clevis 21 having a first arm or actuator arm 21*a* and a second arm or bore arm 21*b*, and a rod end 22. As seen in FIGS. 5 and 6, the clevis 21 has a bore 26 through a central axis 29 and a plurality of bores 33 arcuately spaced around the central axis 29. The bores 33 extend through the actuator arm 21 a of the clevis 21. The rod end 22 has a plurality of sockets 32 and a bore 27. When the rod end 22 is assembled within the actuator arm 21*a* and the bore arm 21*b* the rod end bore 27 is aligned with the central axis 29. The clevis 21 and the rod end 22 are rotatably connected at the central axis using an appropriate fastener such as a bolt 35. The relative rotational movement of the rod end 22 with respect to the clevis actuator arm 21*a* and the bore arm 21*b* is about the post 43 of an actuator 23, as shown in FIG. 5. The plurality of sockets 32 are positioned and configured to coalign selectively with the arcuately spaced bores 33 in the actuator arm 21 a of the clevis. A plurality of locking pins 30 are positioned on top of an equal number of corresponding springs 31 in the sockets 32 of the rod end 22. The bores 33 are sized to accommodate any one of the locking pins 30.

The angular spacing between the bores 33 and the sockets 32 is uniform. The relationship between the number and angular spacing of sockets 32 (and corresponding locking pins 30) and the number and angular spacing of the bores 33 is such that one or more of the locking pins 30 will be urged by its corresponding spring 31 to advance into a corresponding bore 33 (upward as shown in FIG. 5) to lock the rod end 22 and the clevis 21 in a desired locking position. Depending on the relationship between the number and spacing of the locking pins 30 and the number and angular spacing of the bores 33, the relative rotation of the clevis 21 and the rod end 22 can be prevented by the engagement of one, two, three, four, or any desired number of locking pins 30 with the bores 33. Regardless of the number of locking pins 30 that engage the bores to prevent relative rotation, the remaining locking pins 30 that do not engage the bores remain in contact with the smooth inner face of the actuator arm 21*a* of the clevis 21.

In the present invention, when relative rotation of the clevis 21 and the rod end 22 is desired (in order to adjust the positioning of one of the foot support pads, for example) lateral force is applied to the actuator in a direction along the central axis of the bore 26. This causes the actuator pins 34 to move in the bores 33. The actuator pins 34 push the engaged locking pin(s) 30 against the spring(s) 31 and out of the bore(s) 33 in which they are engaged. (The lateral force may be applied directly, such as for individual adjustment of the footrest pads, or remotely in order to lock or unlock a plurality of adjustment mechanisms simultaneously, as discussed above.)

FIGS. 3, 4, 5, and 6 additionally illustrate the clevis 21 and the rod end 22 attached to a clevis fitting 25 and a rod end fitting 24. Overall, this configuration according to the present invention is approximately three times stronger than a mechanism fabricated according to the description contained in U.S. Pat. No. 5,689,999 and only about half as expensive.

One reason for the increased strength and reduced cost of the rotary positioning mechanism of the invention is the use of the clevis fitting 25 and the rod end fitting 24. The clevis fitting 25 fits onto the stem 37 connecting the actuator arm 21*a* and the bore arm 21*b*. The clevis fitting 24 fits onto the rod end 22 of the clevis. These fittings permit the clevis 21 and the rod end 22 to be sized so that they can be fabricated using conventional metal injection molding (MIM) machinery. The use of MIM permits the fabrication of adjustable rotary position mechanisms of the invention to close tolerances using steel, steel alloys, and titanium, for example, in an efficient and cost effective manner. The direct production of components from high tensile strength materials to close tolerances contributes to the reduction of the overall cost of the rotary positioning mechanism and to the increased strength of the positioning mechanisms produced.

Additionally, cost savings and increased applicability are achieved because the clevis fittings 25 and rod end fittings 24 can be fabricated to permit the same adjustable rotary position mechanism to be used in a variety of applications to link variably sized components. Increased applicability increases demand and the use of the same mechanism permits economy of scale.

FIGS. 3 and 4 are enlarged perspective views of an adjustable rotary position mechanism 20 according to the invention. FIG. 3 illustrates the actuator 23, the clevis 21, the clevis fitting 25, the rod end 22, and the rod end fitting 24. FIG. 4 illustrates the bolt 35 through the central axis of the clevis 21 and the fastener 26, the clevis fitting 25, the rod end 22, the actuator 23, and the rod end fitting 24. Both FIG. 3 and 4 illustrate bores 28*a* and 28*b* through the clevis fitting 25 and the rod end fitting 24, respectively. These bores 28*a*, 28*b* permit the fittings (and the rotary position mechanism of the invention) to be used to provide a rotatable coupling between a variety of components. Additionally, these fittings permit rapid assembly, repair, and replacement of the rotary position mechanism.

As shown in FIGS. 5 and 6, bolts 40 are provided to securely attach the rod end fitting 24 to the rod end 22, and to secure the clevis fitting 25 to the clevis. The bolts 40 extend longitudinally through the rod end fitting and clevis fitting, respectively. The rod end fitting 24 and the rod end 22 are preferably both provided with a rectangular cross-sectional shape where they fit together so that the rod end fitting 24 will not rotate. This will also permit the rod end fitting to be rotated 90 degrees if desired. Likewise, the clevis fitting 25 and the clevis stem end 37 can have a rectangular cross-sectional shape. The rod end 22 is shown as having 12 sockets and 12 associated pins 30. The actuator 23 is shown as having 6 actuator pins 34. The actuator pins are arranged with three of the actuator pins positioned within a first arc and the other three of the actuator pins positioned in a second arc that is diametrically opposed to the first arc with respect to the central axis 29. The orientation and arcuate positioning of the 6 actuator pins 34 exactly corresponds with the orientation and arcuate positioning of the 6 bores 33 in the actuator arm 21*a*. Movement of the actuator 23 closer or further away from the actuator arm 21*a* causes the 6 actuator pins 34 to slide through the 6 bores 33 in the actuator arm 21*a*.

Each bore 33 is uniformly spaced from its adjacent bore and each bore is spaced radially an equal distance from the central axis 29. In the rod end 22, there are twelve circumferentially spaced locking pins 30 set in twelve circumferentially spaced sockets 32. The arcuate spacing between adjacent locking pins 30 is uniform and the radial spacing of each locking pin from the central axis of the rod end 22 is also uniform and corresponds to the radial spacing of the bores 33. Although the circumferential spacing between adjacent locking pins 30 is uniform, such spacing differs from that of the bores 33 since there are more locking pins 30 than there are bores 33.

In the preferred embodiment, the arcuate spacing between each adjacent bore compared to the arcuate spacing between adjacent locking pins is preferably arranged so that the difference in the angular spacing between the bores and pins is 10 degrees and the ratio defined by the spacing angle of the locking pins 30 and the bores 33 is such that two of the locking pins 30 are engaged in diametrically opposed bores 33 at the same time. Thus, in the preferred embodiment, two locking pins 30 engage bores 33 to permit adjustment or indexing of the relative rotation of the rotary positioning mechanism in 10 degree increments. The present example is not intended to limit the preferred embodiment to the illustrated quantity and spacing of the locking pins and bores. The preferred 10 degree increments between locking stops can be attained using a variety of different combinations of pins and bores, the configurations of which are included within the scope of the present invention. A variety of alternate configurations are described in U.S. Pat. No. 5,689,999, the contents of which are specifically incorporated by reference, in its entirety.

Figure 7:
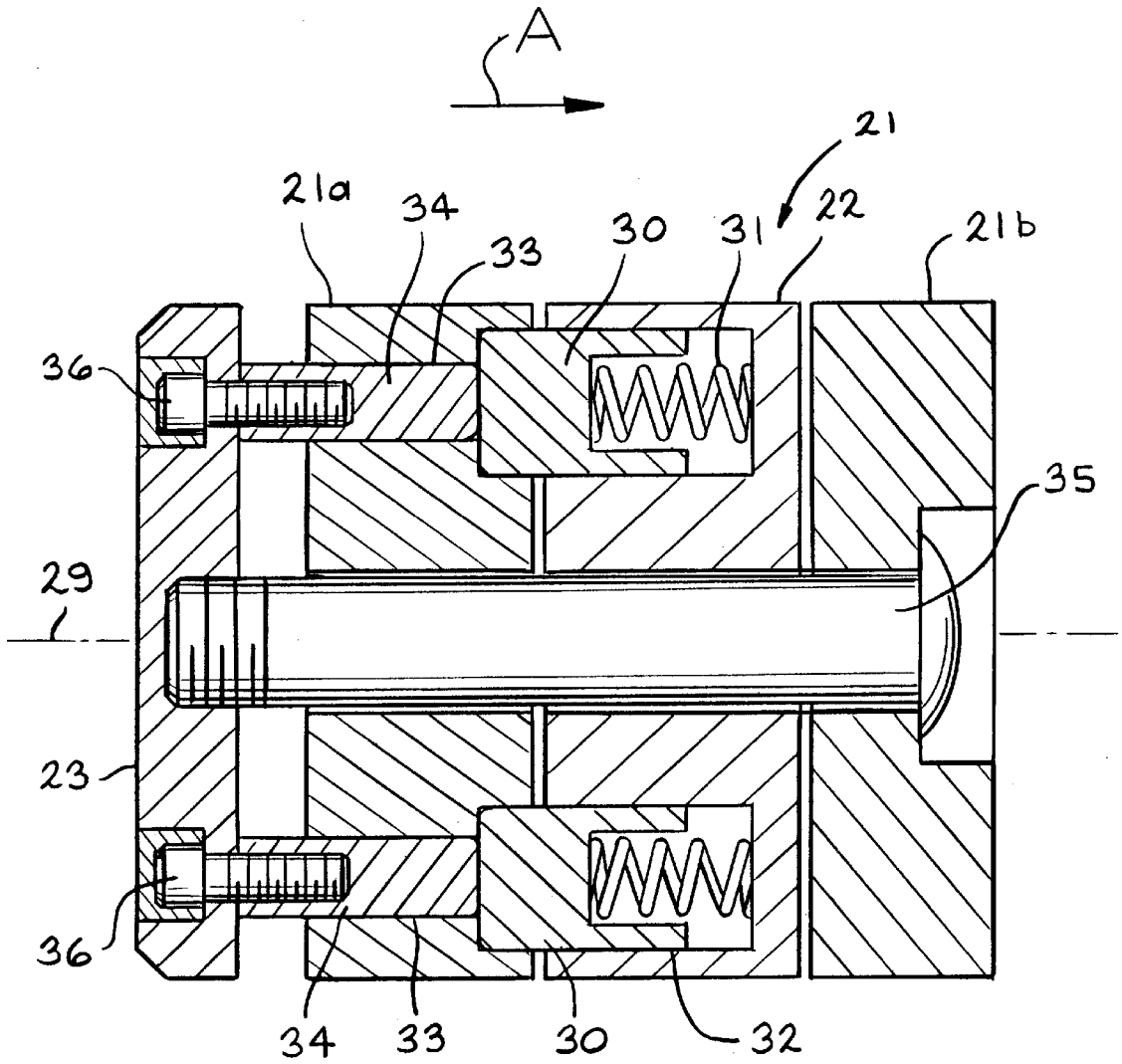
FIG. 7 is a cross-sectional view in elevation of the invention taken along line 7—7 of FIG. 4, illustrating the locking pins projecting into the bores in the clevis to prevent relative rotation of the clevis and the rod end.
Figure 8:
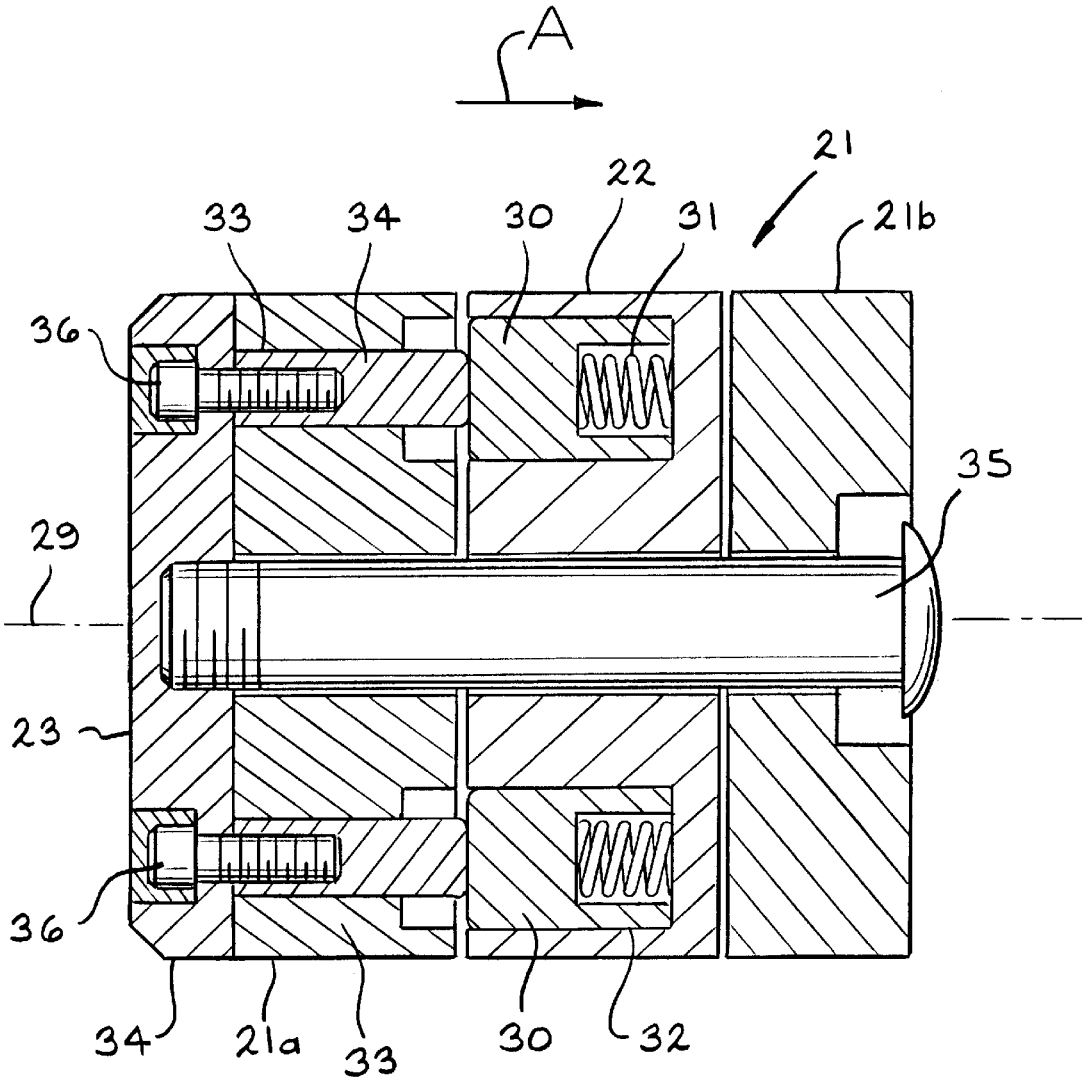
FIG. 8 is the same cross-sectional view as FIG. 7 illustrating the actuator pins displacing the locking pins into the bores of the clevis to permit relative rotation of the clevis and the rod end.

FIGS. 7 and 8 illustrate how the relative rotation of the clevis 21 and the rod end 22 is prevented or permitted by the engagement or disengagement, respectively, of locking pins 30 in the bores 33. More specifically, as illustrated in FIGS. 7 and 8, the clevis 21, the rod end 22, and the actuator 23 are held together by the bolt 35. The rod end 22 has a plurality of arcuately spaced sockets 32 (two of which are visible in FIG. 7 and FIG. 8). In potential communication with diametrically disposed sockets 32 are a pair of bores 33 through the actuator side 21*a* of the clevis. Slideably positioned in each of the bores 33 is an actuator pin 34 connected, i.e., rigidly fixed, to the actuator 23. The actuator pins 34 are in contact with the locking pins 30 that are biased into the bore 33 by the springs 31 as shown in FIG. 7. To rotate the clevis 21 relative to the rod end 22, pressure is exerted on the actuator in the direction of the arrow A along the central axis 29 of the mechanism. This causes the actuator pins 34 to push against the locking pins 30 present in the bores 33 and compress the springs 31 resulting in retraction of the locking pins 30 out of the bores 33 as shown in FIG. 8. It is essential that the movement of the actuator pins 34 be sufficient to effect complete withdrawal of the locking pins 30 from the bores 33. But the movement should not be so great as to cause any part of an actuator pin 34 to project into any of the sockets 32. The extent of movement of the actuator pins 34 may be controlled, for example by adjustment bolts 36 threaded into the actuator pins 34, or by establishing the length of the actuator pins to extend into the bores 33 only to the bottom of the bores, and not past the bottom of the bores.

FIGS. 7 and 8 also illustrate the close tolerances attained using MIM to fabricate the clevis 21, rod end 22, and actuator 23. Locking pins 30 and actuator pins 34 having compatible tolerances may be fabricated using a variety of methods. As discussed above, these close tolerances increase the strength of the mechanism of the present invention. In addition, these close tolerances provide for an accurate fit between the locking pins 30 and the bores 33, and this tends to minimize unwanted relative rotation of the clevis 21 and the rod end 22 when the locking pins 30 are engaged in the bores 33.

In order to retract both of the locking pins 30 engaged in the bores 33, relative lateral force is applied to the actuator 23. This lateral force moves all six actuator pins 34 in their corresponding bores 33. Two of the actuator pins 34 (such as illustrated above with reference to FIGS. 7 and 8) contact the two engaged locking pins that are within the bores, pressing the pins out of engagement with the bores 33, i.e., in the direction of arrow A as shown in FIG. 7.

As long as sufficient force is applied to the actuator to keep the parts in the positions shown in FIG. 8, the clevis 21 and the rod end 22 are free to rotate relative to each other. However, if the force applied to the actuator 23 is removed following sufficient relative rotation of the rod end and the clevis so that no locking pin 30 projects into a bore 33, a further slight relative rotation will occur only until a locking pin 30 registers in one of the bores 33. When a locking pin 30 aligns with a bore 33, the spring 31 projects the locking pin 30 into the bore 33. Optionally, an additional spring (not shown) could be positioned between the head of the bolt 35 and the clevis 21 to exert a force that would tend to return the actuator 23 and actuator pins 34 to a retracted position, i.e., the position shown in FIG. 7. In the illustrated preferred embodiment, spacing and positioning of the bores 33 and locking pins 30 are such that diametrically opposite locking pins are projected into diametrically opposite bores after a relative rotation of 10 degrees.

Other changes in the numbers of sockets and locking pins may be made. In all instances, however, there will be a difference in the number of locking pins and the number of sockets and, consequently, a difference between the angular spacing of the pins and sockets. These differences will depend upon factors such as the degree of incremental relative rotation desired and whether only one or more than one locking pin will be accommodated in the bores at any one time.

While the invention has been described in conjunction with a rotary positioning mechanism for readily adjusting the angle of a footrest on a wheelchair, the rotary positioning mechanism can be used for other functions on a wheelchair, such as for adjusting the handle 11 relative to the seat back 5*b* or the handle extension 6, or such as adjusting the angle between the seat frame 5*a* and the seat back 5*b*. It is also to be understood that the rotary positioning mechanism of the invention can be used for other applications, such as for locking the position of a tiller in a scooter, not shown, or for locking articulating arms in various items of equipment, also not shown.

While the locking pins 30 are shown in FIGS. 7 and 8 as having a bore so that the springs 31 can be contained or held in place, it is to be understood that the bore can be eliminated from the locking pins 30, and the locking pins can be provided with a flat end, not shown, against which the springs can push.

The principle and mode of operation of this invention have been described in its preferred embodiments. However, it should be noted that this invention may be practiced otherwise than as specifically illustrated and described without departing from its scope.

I claim:

1. An adjustable rotary positioning mechanism, comprising:

a clevis having a central axis, a first arm, a second arm, and a plurality of bores arcuately spaced around the central axis through the first arm of the clevis;

a rod end having a central axis and a plurality of sockets, the rod end rotatably connected to the clevis through the central axis, the plurality of sockets arcuately spaced around the central axis and capable of being positioned colinearly with the bores; and a plurality of locking pins carried in the sockets and configured to project into the plurality of bores to lock the clevis and the rod end together, thereby preventing relative rotation of the rod end with respect to the clevis, the locking pins being configured to retract from the bores to permit relative movement of the clevis and the rod end, where spacing and quantity of the plurality of locking pins and spacing and quantity of the plurality of bores are configured so that one, two, three, or four locking pins project into the plurality of bores to lock the clevis and the rod end together.

2. The adjustable rotary positioning apparatus of claim 1, further comprising an actuator for pushing the locking pins out of the bores.

3. The adjustable rotary positioning apparatus of claim 2 where the actuator has pins for pushing the locking pins out of the bores.

4. The adjustable rotary positioning apparatus of claim 1 where the plurality of locking pins are greater in number than the plurality of bores.

5. The adjustable rotary positioning apparatus of claim 1 where the spacing and quantity of the plurality of locking pins and the spacing and quantity of the plurality of bores are configured so that two diametrically opposite locking pins project into the plurality of bores to lock the clevis and the rod end together at 10 degree intervals.

6. The adjustable rotary positioning apparatus of claim 1 fabricated using metal injection molding.

7. The adjustable rotary positioning apparatus of claim 1, further comprising a clevis fitting attached to the clevis, and a rod end fitting attached to the rod end.

8. The adjustable rotary positioning apparatus of claim 7 in which the cross-sectional shape of both the clevis fitting and the rod end fitting is rectangular.

9. The adjustable rotary positioning apparatus of claim 7 where at least the clevis and the rod end are fabricated using metal injection molding.

10. The adjustable rotary positioning apparatus of claim 7 in which the clevis fitting is attached to the clevis with a bolt extending longitudinally through the clevis fitting, and the rod end fitting is attached to the rod end with a bolt extending through the rod end fitting.

11. An adjustable rotary positioning mechanism comprising:

a clevis having a central axis, a first arm, a second arm, and a plurality of bores arcuately spaced around the central axis through the first arm of the clevis;

a rod end having a central axis and a plurality of sockets, the rod end rotatably connected to the clevis through the central axis, the plurality of sockets arcuately spaced around the central axis and capable of being positioned colinearly with the bores;

a plurality of locking pins carried in the sockets and configured to project into the plurality of bores to lock the clevis and the rod end together, thereby preventing relative rotation of the rod end with respect to the clevis, the locking pins being configured to retract from the bores to permit relative movement of the clevis and the rod end; and an actuator for pushing the locking pins out of the bores, the actuator having actuator pins, equal in number to the number of bores, for pushing the locking pins out of the bores.

12. The adjustable rotary positioning apparatus of claim 11 where the number of actuator pins is equal to the number of bores.

13. The adjustable rotary positioning apparatus of claim 11 where the spacing and quantity of the plurality of locking pins and the spacing and quantity of the plurality of bores are chosen so that two diametrically opposite locking pins project into the plurality of bores to lock the clevis and the rod end together at 10 degree intervals.

14. The adjustable rotary positioning apparatus of claim 13, further comprising a clevis fitting attached to the clevis, and a rod end fitting attached to the rod end, where the cross-sectional shape of both the clevis fitting and the rod end fitting is rectangular.

15. A wheelchair having an adjustable foot support comprising: a frame, drive wheels and steerable wheels supporting the frame, and paired foot supports each adjustably connected to the frame using an adjustable rotary positioning mechanism comprising:

a clevis having a central axis, a first arm, a second arm, and a plurality of bores arcuately spaced around the central axis through the first arm of the clevis;

a rod end having a central axis and a plurality of sockets, the rod end rotatably connected to the clevis through the central axis, the plurality of sockets arcuately spaced around the central axis and capable of being positioned colinearly with the bores; and a plurality of locking pins carried in the sockets and configured to project into the plurality of bores to lock the clevis and the rod end together, thereby preventing relative rotation of the rod end with respect to the clevis, the locking pins being configured to retract from the bores to permit relative movement of the clevis and the rod end, where spacing and quantity of the plurality of locking pins and spacing and quantity of the plurality of bores are configured so that one two three or four locking pins project into the plurality of bores to lock the clevis and the rod end together.

16. The wheelchair of claim 15, further comprising an actuator having actuator pins, equal in number to the number of bores, for pushing the locking pins out of the bores.

17. The wheelchair of claim 15 where the spacing and quantity of the plurality of locking pins and the spacing and quantity of the plurality of bores are configured so that two diametrically opposite locking pins project into the plurality of bores to lock the clevis and the rod end together at 10 degree intervals.

18. The wheelchair of claim 17, further comprising a clevis fitting attached to the clevis, and a rod end fitting attached to the rod end, where the cross-sectional shape of both the clevis fitting and the rod end fitting is rectangular.

19. A wheelchair having an adjustable foot support comprising: a frame, drive wheels and steerable wheels supporting the frame, and paired foot supports each adjustably connected to the frame using an adjustable rotary positioning mechanism comprising:

a clevis having a central axis, a first arm, a second arm, and a plurality of bores arcuately spaced around the central axis through the first arm of the clevis;

a rod end having a central axis and a plurality of sockets, the rod end rotatably connected to the clevis through the central axis, the plurality of sockets arcuately spaced around the central axis and capable of being positioned colinearly with the bores;

a plurality of locking pins carried in the sockets and configured to project into the plurality of bores to lock the clevis and the rod end together, thereby preventing relative rotation of the rod end with respect to the clevis, the locking pins being configured to retract from the bores to permit relative movement of the clevis and the rod end; and an actuator for pushing the locking pins out of the bores, the actuator having actuator pins for pushing the locking pins out of the bores.

20. The wheelchair of claim 19 where the number of actuator pins is equal to the number of bores.

21. The wheelchair of claim 19 where the spacing and quantity of the plurality of locking pins and the spacing and quantity of the plurality of bores are configured so that two diametrically opposite locking pins project into the plurality of bores to lock the clevis and the rod end together at 10 degree intervals.

22. The wheelchair of claim 21, further comprising a clevis fitting attached to the clevis, and a rod end fitting attached to the rod end, where the cross-sectional shape of both the clevis fitting and the rod end fitting is rectangular.

23. An adjustable rotary positioning mechanism comprising:

a clevis having a central axis, a first arm, a second arm, and a plurality of bores arcuately spaced around the central axis through the first arm of the clevis;

a rod end having a central axis and a plurality of sockets, the rod end rotatably connected to the clevis through the central axis, the plurality of sockets arcuately spaced around the central axis and capable of being positioned colinearly with the bores;

a plurality of locking pins carried in the sockets and configured to project into the plurality of bores to lock the clevis and the rod end together, thereby preventing relative rotation of the rod end with respect to the clevis, the locking pins being configured to retract from the bores to permit relative movement of the clevis and the rod end; and an actuator for pushing the locking pins out of the bores, the actuator having actuator pins for pushing the locking pins out of the bores.

24. The wheelchair of claim 23 where the number of actuator pins is equal to the number of bores.

25. The wheelchair of claim 23 where the spacing and quantity of the plurality of locking pins and the spacing and quantity of the plurality of bores are configured so that two diametrically opposite locking pins project into the plurality of bores to lock the clevis and the rod end together at 10 degree intervals.

26. The wheelchair of claim 25 further comprising a clevis fitting attached to the clevis, and a rod end fitting attached to the rod end, where the cross-sectional shape of both the clevis fitting and the rod end fitting is rectangular.

* * * * *